US005390419A

United States Patent [19]

Sirkis

[11] Patent Number: 5,390,419

[45] Date of Patent: Feb. 21, 1995

[54] TELESCOPIC-SIGHT MOUNT

[75] Inventor: Nehemia Sirkis, Los Angeles, Calif.

[73] Assignee: VOERE Kufsteiner Gerätebau-und Handelsgesellschaft m.b.H., Kufstein, Austria

[21] Appl. No.: 122,489

[22] PCT Filed: Jan. 28, 1993

[86] PCT No.: PCT/AT93/00011

§ 371 Date: Nov. 19, 1993

§ 102(e) Date: Nov. 19, 1993

[87] PCT Pub. No.: WO93/15371

PCT Pub. Date: Aug. 5, 1993

[30] Foreign Application Priority Data

Jan. 29, 1992 [AT] Austria ..... A 142/92

[51] Int. Cl.[6] ..... F41G 1/387

[52] U.S. Cl. ..... 33/250; 33/245

[58] Field of Search ..... 33/245, 246, 247, 248, 33/249, 250, 252, 253, 254, 255, 256, 257, 258, 259; 42/100, 101, 102, 103, 104

[56] References Cited

U.S. PATENT DOCUMENTS

| | | | |
|---|---|---|---|
| 1,144,647 | 6/1915 | Fidjeland | 33/250 |
| 2,450,466 | 10/1948 | Carlson | 33/250 |
| 2,510,289 | 6/1950 | Livermore | 33/250 |
| 2,621,410 | 12/1952 | Street | 33/250 |
| 2,710,453 | 6/1955 | Beverly | 33/249 |
| 2,739,384 | 3/1956 | Chokae | 33/250 |
| 2,836,895 | 6/1958 | Dillon | 33/245 |
| 2,942,346 | 6/1960 | Staubach | 33/250 |
| 3,153,856 | 10/1964 | Felix | 33/247 |
| 3,205,579 | 9/1965 | Plisk | 33/250 |
| 5,070,637 | 12/1991 | French | 33/250 |

FOREIGN PATENT DOCUMENTS

| | | | |
|---|---|---|---|
| 651589 | 6/1962 | Canada | 33/250 |
| 157992 | 7/1990 | European Pat. Off. . | |
| 7038599 | 10/1970 | Germany . | |
| 8312673.2 | 9/1983 | Germany . | |
| 12339 | 5/1914 | United Kingdom . | |

OTHER PUBLICATIONS

*Knight's American Mechanical Dictionary*, pp. 2585–2586, 1884.

*McGraw-Hill Encyclopedia of Science & Technology* (1960), vol. 13, p. 664.

*Mack's Standard Handbook for Mechanical Engineers* (Ninth Edition, 1987) pp. 8–9.

Webster's New Twentieth Century Dictionary (Unabridged, Second Edition, 1983).

*Primary Examiner*—William A. Cuchlinski, Jr.
*Assistant Examiner*—G. Bradley Bennett
*Attorney, Agent, or Firm*—Wenderoth, Lind & Ponack

[57] ABSTRACT

Described is a mount for a telescopic sight. The mount has two pairs of spaced engaging elements which can be locked to each other. A spring-biased bolt mounted in a carrier element is displaced by means of an elbow or toggle lever and braces one pair of the spaced engaging elements against the other pair.

11 Claims, 3 Drawing Sheets

TELESCOPIC-SIGHT MOUNT

BACKGROUND OF THE INVENTION

The invention relates to a mounting for an aiming telescope, in particular for small arms, with a supporting mechanism which can be mounted on a weapon, and with a carrying mechanism which can be mounted on the aiming telescope and which can be attached to the supporting mechanism, wherein the supporting and the carrying mechanisms exhibit one pair each of engaging elements that are spaced apart.

Such an aiming telescope mounting can be inferred, for example, from the DE-Gbm 70 38 599 or DE-Gbm 83 12 673. Both of these aiming telescope mountings exhibit one holding mechanism that can be rotated on the front and one holding mechanism that can be locked on the rear. Each of the holding mechanisms comprises two engaging elements that are individually mounted.

To mount the aiming telescope on the weapon, the front engaging element of the aiming telescope is slid on the front engaging element of the weapon and rotated into the working position, whereby the rear engaging element of the aiming telescope is swung into the undercut groove of the rear engaging element of the weapon. A rotatable bolt provided in the holding mechanism fixes the working position. For the mounting according to the DE-Gbm 70 38 599 there is also a second rotatable bolt, which serves to adjust the engaging element in the groove and thus adjust the aiming telescope.

The engaging elements of these mountings represent single elements which are mounted on the weapon or on the aiming telescope, whereby the telescope and/or the weapon make the connection between the engaging elements of each pair. Therefore the space between the engaging elements can vary widely, due to temperature influences, so that the adjustment suffers.

SUMMARY OF THE INVENTION

Thus, the object of the invention is to provide a mounting for an aiming telescope or telescopic sight mount that avoids the described drawback and achieves this by bracing the engaging elements of one of the two pairs by changing their distance against the engaging elements of the second pair.

Thus the result is a mounting in which undesired changes in distance that affect the adjustment are superimposed on the change in distance causing the bracing, and thus are made ineffective.

The distance is preferably changed by means of a toggle lever. It allows a relatively long displacement path, so that the aiming telescope can be conveniently mounted and dismounted.

The braceable engaging elements are preferably provided on a carrier body, where an engaging element is formed especially by the free end of a spring-loaded bolt that can be moved by means of a toggle lever. In a preferred embodiment, the toggle lever is hinged to a slider from which a guide pin projects, on which guide pin the bolt slides, with a compression spring braced between the slider and the bolt.

The bracing can simultaneously center if the free end of the bolt tapers off and the engaging element of the supporting mechanism that interacts with the free end of the bolt exhibits a tapered depression. The depression is, in particular, conical, and the free end of the bolt is rounded.

DETAILED DESCRIPTION OF THE PREFERRED EMBODIMENT

Figure 1:
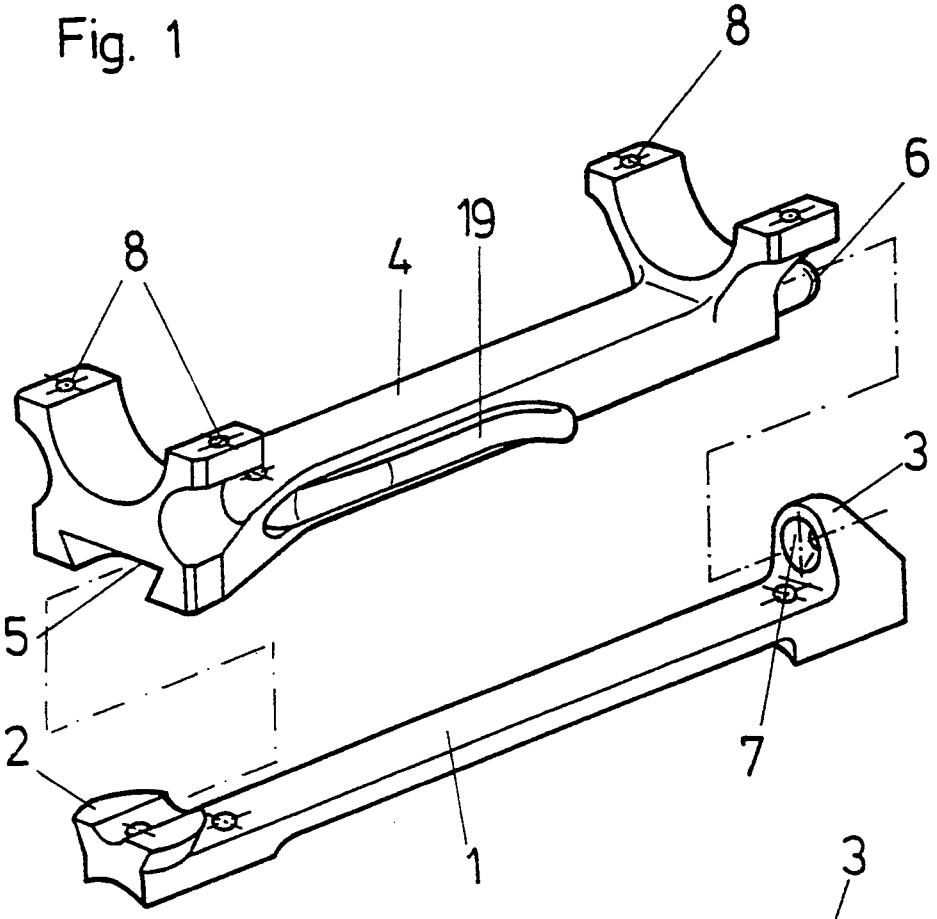
FIG. 1 is an exploded drawing of an aiming telescope mounting.
Figure 2:
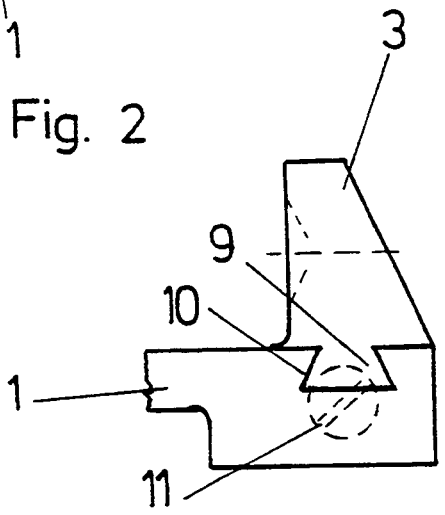
FIG. 2 is a detail of one attachment side of the mounting.

An aiming telescope mounting comprises a supporting mechanism 1, which has, for example, bores for mounting it on the weapon. The ends have a first pair of engaging elements 2 and 3. The engaging element 2 has the shape of a truncated cone, and is expanded toward the top and flattened off on a front side. The engaging element 3 has a depression 7 on a face thereof, which extends vertically to the longitudinal direction and points to the engaging element 2. A carrying mechanism 4 is attached, by way of straps 8, to an aiming telescope, and also has a pair of engaging elements 5 and 6. Following insertion of the engaging elements 5 and 6 into the engaging elements 2 and 3, the aiming telescope is removeably connected to the weapon. For adjustment, the engaging element 3 of the first pair can be attached to the supporting mechanism 1 as shown in FIG. 2. The supporting mechanism 1 has an undercut groove 10 which extends perpendicularly to the longitudinal direction and receives a wedge-shaped segment 9 of the engaging element 3. The adjustment is possible by way of a setscrew indicated at 11.

The carrying mechanism 4 has an oblong carrier body 12 having a first end having the engaging element 5, which has a semi-conical recess. Thus the carrier body 12 can be slid from any arbitrary side on to the engaging element 2 (FIGS. 3 and 5) and can then be rotated as desired (FIG. 4). The carrier body 12 is further provided with a longitudinal recess 13 in which a bolt 14 can be moved in the longitudinal direction by way of a toggle lever 18. The rounded end of the bolt 14 issuing from the recess 13 forms the second engaging element 6 of the carrying mechanism 4, and can be moved into the trough or depression 7 in the engaging element 3. The toggle lever 18 is mounted on the carrier body 12, on the one hand, and hinged, on the other hand, to a slider 15, which can be slid in the recess 13 and is provided with a guide pin 17. The bolt 14 has a borehole in which the guide pin 17 is held. Between the slider 15 and the bolt 14 is a compression spring 16, whereby a head of the guide pin 17 serves in the expanded part of the bore hole as an abutment. Therefore, the guide pin 17 is preferably formed by means of a barrier inserted into the slider 15.

Figure 3:
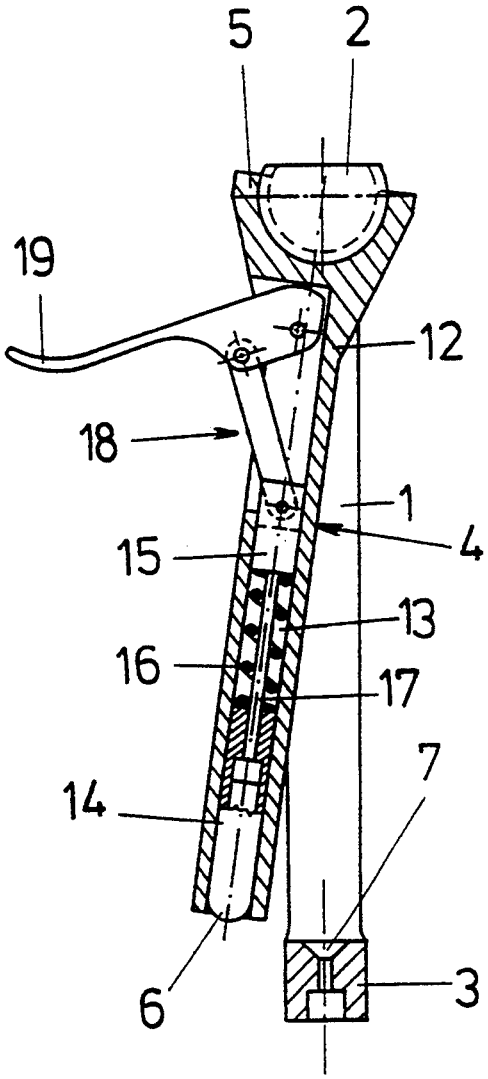
FIGS. 3 and 4 depict a first embodiment of the mounting in a mounting and a holding position.
Figure 4:
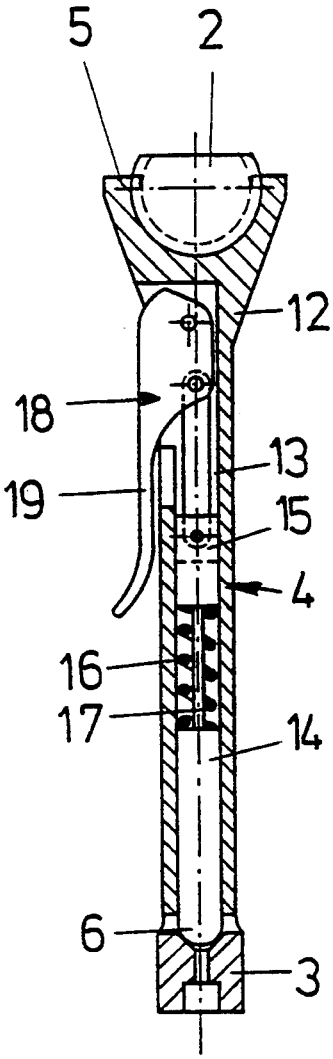
Figure 5:
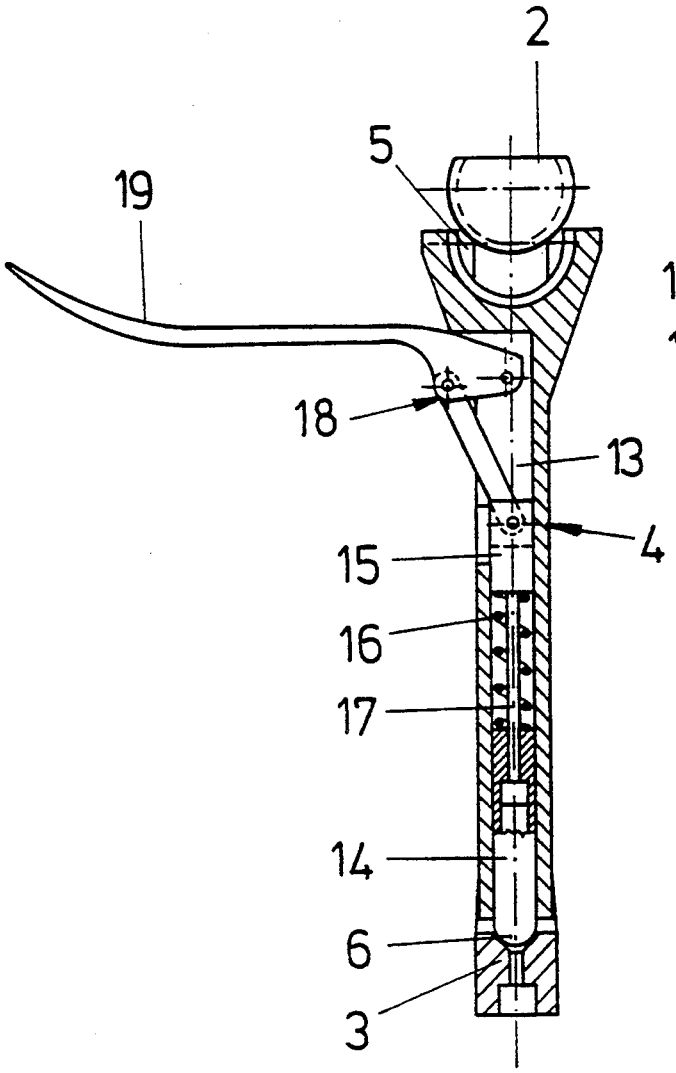
FIGS. 5 and 6 depict a second embodiment, also in a mounting and a holding position.
Figure 6:
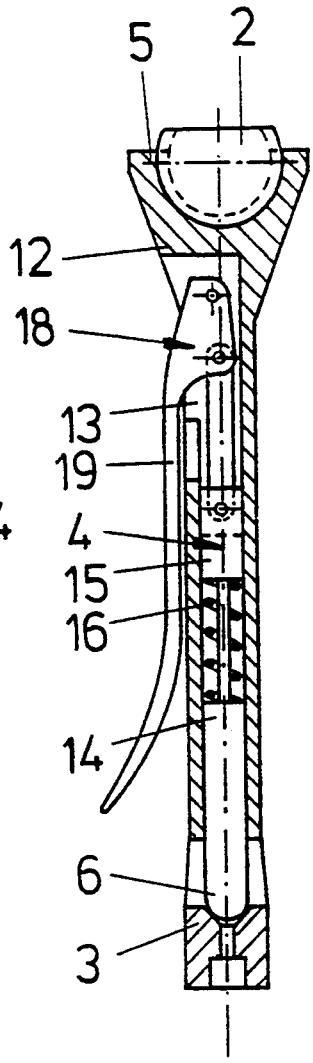

To mount the aiming telescope, as shown in FIGS. 3 and 5, a handle 19 of the toggle lever 18 is swung out so that the distance between the two engaging elements 5 and 6 is small. At the same time, either the engaging element 5 can first be slid on to the engaging element 2 (FIGS. 3, 4), or the engaging element 6 can be inserted into the engaging element 3 (FIGS. 5, 6). By tightening the toggle lever 18, the distance between the two engaging elements 5 and 6 is increased, whereby according to FIGS. 3 and 4, the free end of the bolt 14 is slid into the recess 7, and according to FIGS. 5 and 6, the free end of the carrier body 12 is slid forward and the engaging element 5 is slid on to the conical engaging element 2.

I claim:

1. A telescopic sight mount, comprising:

a support mechanism to be mounted on a weapon, said support mechanism comprising a first pair of spaced engaging elements;

a carrying mechanism to be mounted to a telescopic sight, said carrying mechanism comprising a second pair of spaced engaging elements which can be attached to said supporting mechanism; and a toggle lever arranged between said engaging elements of one of said first and second pairs of spaced engaging elements, the one of said first and second pairs being braceable against the other of said first and second pairs of spaced engaging elements by changing the spacing of said engaging elements of the one of said first and second pairs, and said toggle lever comprising a tension handle.

2. The telescopic sight mount of claim 1, wherein said carrying mechanism comprises a common carrier body, the one of said first and second pairs being said second pair and being provided on said common carrier body.

3. The telescopic sight mount of claim 2, wherein said carrying mechanism comprises a bolt connected to and movable by said toggle lever, said bolt having a free end defining one of said engaging elements of said second pair.

4. The telescopic sight mount of claim 3, wherein said toggle lever is pivotally connected to a slider, said slider has a guide pin projecting therefrom, and said bolt slides on said guide pin and has a compression spring braced between said slider and said bolt.

5. The telescopic sight mount of claim 4, wherein said free end of said bolt is tapered and one of said engaging elements of said first pair includes a tapered depression for receiving said free end of said bolt.

6. A mount for a telescopic sight, comprising:

a support mechanism adapted to be mounted on a weapon, said support mechanism comprising a first pair of spaced engaging elements;

a carrying mechanism adapted to be mounted to a telescopic sight, said carrying mechanism comprising a second pair of spaced engaging elements that can be attached with said first pair to mount said carrying mechanism on said support mechanism; and a toggle lever connecting said spaced engaging elements of one of said first and second pairs for relative movement therebetween, said toggle lever comprising a handle pivotally mounted with respect to one of said spaced engaging elements of the one of said first and second pairs and a link pivotally connected to said handle, said link being operable connected with the other of said spaced engaging elements of the one of said first and second pairs.

7. The mount for a telescopic sight of claim 6, wherein the one of said pair is said second pair of spaced engaging elements of said carrying mechanism.

8. The mount for a telescopic sight of claim 7, wherein said carrying mechanism comprises a carrier body having a longitudinal recess therein, one of said second pair of spaced engaging elements is a recess on one end of said carrier body, the other of said second pair of spaced engaging elements is defined by a bolt slidably disposed in said longitudinal recess, and said handle is pivotally connected to said carrier body and said link is operably connected with said bolt.

9. The mount for a telescopic sight of claim 8, wherein a slider is pivotally connected with said link, said slider having a guide pin on which said bolt is guided, and a compression spring being disposed between said bolt and said slider.

10. The mount for a telescopic sight of claim 8, wherein said first pair of spaced engaging elements of said support mechanism comprises a first element for receipt in said recess on one end of said carrier body and a second element defining a recess for receiving an end of said bolt.

11. The mount for a telescopic sight of claim 6, wherein said handle is pivotally mounted on said carrying mechanism.

* * * * *